US010806962B2

(12) United States Patent
Sarazen

(10) Patent No.: US 10,806,962 B2
(45) Date of Patent: Oct. 20, 2020

(54) FITNESS APPARATUS

(71) Applicant: FITSTICKS LLC, Lattimore, NC (US)

(72) Inventor: Paul Sarazen, Lattimore, NC (US)

(73) Assignee: FITSTICKS, LLC, Lattimore, NC (US)

( * ) Notice: Subject to any disclaimer, the term of this patent is extended or adjusted under 35 U.S.C. 154(b) by 30 days.

(21) Appl. No.: 16/174,802

(22) Filed: Oct. 30, 2018

(65) Prior Publication Data

US 2019/0060698 A1 Feb. 28, 2019

Related U.S. Application Data

(63) Continuation-in-part of application No. 15/915,274, filed on Mar. 8, 2018, now Pat. No. 10,143,274.

(60) Provisional application No. 62/468,465, filed on Mar. 8, 2017.

(51) Int. Cl.

| | |
|---|---|
| ***A63B 21/06*** | (2006.01) |
| ***A63B 22/00*** | (2006.01) |
| ***A63B 21/00*** | (2006.01) |
| ***A45B 3/00*** | (2006.01) |
| *A45B 3/08* | (2006.01) |

(52) U.S. Cl.

CPC ..... *A63B 21/0605* (2013.01); *A45B 3/00* (2013.01); *A63B 21/0004* (2013.01); *A63B 22/0005* (2015.10); *A63B 22/0048* (2013.01); *A45B 3/08* (2013.01); *A63B 2208/0204* (2013.01)

(58) Field of Classification Search

CPC ..... A63B 21/0605; A63B 22/0005; A63B 21/0004; A63B 22/0048; A63B 2208/0204; A45B 3/00; A45B 3/08

See application file for complete search history.

(56) References Cited

U.S. PATENT DOCUMENTS

| | | | | |
|---|---|---|---|---|
| 3,004,474 | A | 10/1961 | Hund | |
| 3,332,429 | A * | 7/1967 | Bates | A45D 40/26 132/317 |
| 5,487,711 | A | 1/1996 | Little | |
| 5,878,445 | A * | 3/1999 | Suderski | A61J 19/00 4/258 |
| 8,360,938 | B2 | 1/2013 | Gilman | |
| 9,192,803 | B2 | 11/2015 | Cayo | |
| D770,571 | S | 11/2016 | Rahnasto | |
| 9,789,349 | B2 | 10/2017 | Rahnasto | |
| D826,504 | S * | 8/2018 | Garcia | D32/74 |
| 10,143,274 | B2 | 12/2018 | Sarazen | |
| 2009/0206569 | A1* | 8/2009 | Begin | B62B 3/04 280/47.35 |
| 2011/0224051 | A1 | 9/2011 | Larish | |
| 2012/0318203 | A1* | 12/2012 | Andrade | A01K 1/0114 119/166 |
| 2013/0143693 | A1 | 6/2013 | Forrest, Sr. | |
| 2014/0352054 | A1* | 12/2014 | Tollasepp | A47J 47/20 4/654 |

(Continued)

OTHER PUBLICATIONS http:/www.flurocarbon.co.uk/news-and-events/post/18/what-is-ultra-high-molecular-weight-polyethylene-uhmwpe archived: Apr. 10, 2017 retrived Jun. 26, 2018 by Examiner.

*Primary Examiner* — Andrew S Lo

(74) *Attorney, Agent, or Firm* — J. Bennett Mullinax, LLC

(57) ABSTRACT

An exercise apparatus is provided having a handle pivotally attached to a flat base, the base and handle each configured for receiving optional weights, the flat base providing resistance when the handle moves the base along a surface.

12 Claims, 8 Drawing Sheets

(56) References Cited

U.S. PATENT DOCUMENTS

| | | | | |
|---|---|---|---|---|
| 2015/0274416 | A1* | 10/2015 | Garcia | B65F 1/02 220/200 |
| 2017/0189733 | A1 | 7/2017 | Bentley | |
| 2017/0258279 | A1* | 9/2017 | Wahl | B65D 43/16 |
| 2017/0326402 | A1 | 11/2017 | Sorin | |

* cited by examiner

FITNESS APPARATUS

RELATED APPLICATION

This application is a continuation-in-part of the U.S. utility patent application having Ser. No. 15/915,274, filed on Mar. 8, 2018 and which is incorporated herein by reference and which claims the benefit of U.S. Provisional Patent Application No. 62/468,465, filed Mar. 8, 2017 and which is incorporated herein by reference.

FIELD OF THE INVENTION

This invention is directed towards an exercise apparatus such as an exercise stick that provides for an improvement in an exercise workout.

BACKGROUND OF THE INVENTION

This invention relates generally to exercise sticks and walking poles that are used for walking and exercise. While the therapeutic benefits of using a fitness apparatus such as an exercise stick or walking pole are well known, there remains room for improvement with respect to the process of using exercise sticks and the ability to enhance the health benefits by modifying the structure of the fitness apparatus.

Accordingly, there remains room for improvement and variation within the art.

SUMMARY OF THE INVENTION

It is one aspect of at least one of the present embodiments to provide for fitness apparatus in the form of an exercise stick or walking pole that is pivotally attached to a flat base which provides additional resistance when the fitness apparatus is used.

It is a further aspect of at least one of present embodiments to provide for an exercise or walking stick having a rod, an end of the rod being adapted for engagement with a pivot member, the pivot member attached to the base which is further adapted for holding a weighted object placed on an upper surface of the flat base. In this manner, one using the walking stick for exercise can place an adjustable and variable amount of weight onto the base of the exercise apparatus. The pivot attachment between the rod and the base of the walking stick allows for flexible movement between the stick and the base as part of a walking movement. The base and weight associated with the base increases the resistance of moving the walking stick, improves the cardiovascular benefits, and increases the muscle resistance to the user.

It is a further aspect of at least one of present embodiments to provide for a fitness apparatus comprising of or consisting of A fitness apparatus comprising:

a base;

a multi-walled receptacle defining an open volume and secured to an upper surface of the base, the receptacle having a front wall, and rear wall, and a pair of opposing side walls, the receptacle further defining four corner walls, each corner wall defining a curved interior wall surface:

wherein, each side wall is curved along its height a mid point of and at the wall, the height of the rear wall being greater than the height of the front wall, the rear wall, front wall, respective side walls and respective corner walls all extending in an outwardly tapering direction relative to a central vertical axis of the receptacle.

It is a further aspect of at least one of present embodiments to provide for a fitness apparatus as described above wherein, the rod defines a handle portion having a larger diameter stop member secured thereto, the stop member adapted for supporting a weight placed over a handle portion of the rod.

It is a further aspect of at least one of present embodiments to provide for a process of using a fitness apparatus comprising the steps of A process of using a fitness apparatus comprising the steps of:

supplying a fitness apparatus comprising;

a base;

a multi-walled receptacle defining an open volume and secured to an upper surface of the base, the receptacle having a front wall, and rear wall, and a pair of opposing side walls, the receptacle further defining four corner walls, each corner wall defining a curved interior wall surface;

wherein, each side wall is curved along its height a mid point of and at the wall, the height of the rear wall being greater than the height of the front wall, the rear wall, front wall, respective side walls and respective corner walls all extending in an outwardly tapering direction relative to a central vertical axis of the receptacle.

It is a further aspect of at least one of present embodiments to provide for a process as described above wherein a pair of fitness apparatuses are used in tandem by an individual.

It is a further aspect of at least one of present embodiments to provide for a process as described above containing the additional step of adding a weight to the upper base surface.

It is a further aspect of at least one of present embodiments to provide for a process as described above comprising the additional step of adding a weight to the handle portion of the rod.

It is a further aspect of at least one of present embodiments to provide for a fitness apparatus as described above wherein a lower surface of the flat base defines an arcutate curvature along at least one edge of the base.

It is a further aspect of at least one of present embodiments to provide for a fitness apparatus as described above wherein the flat base is made of ultra high molecular weight polyethylene.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
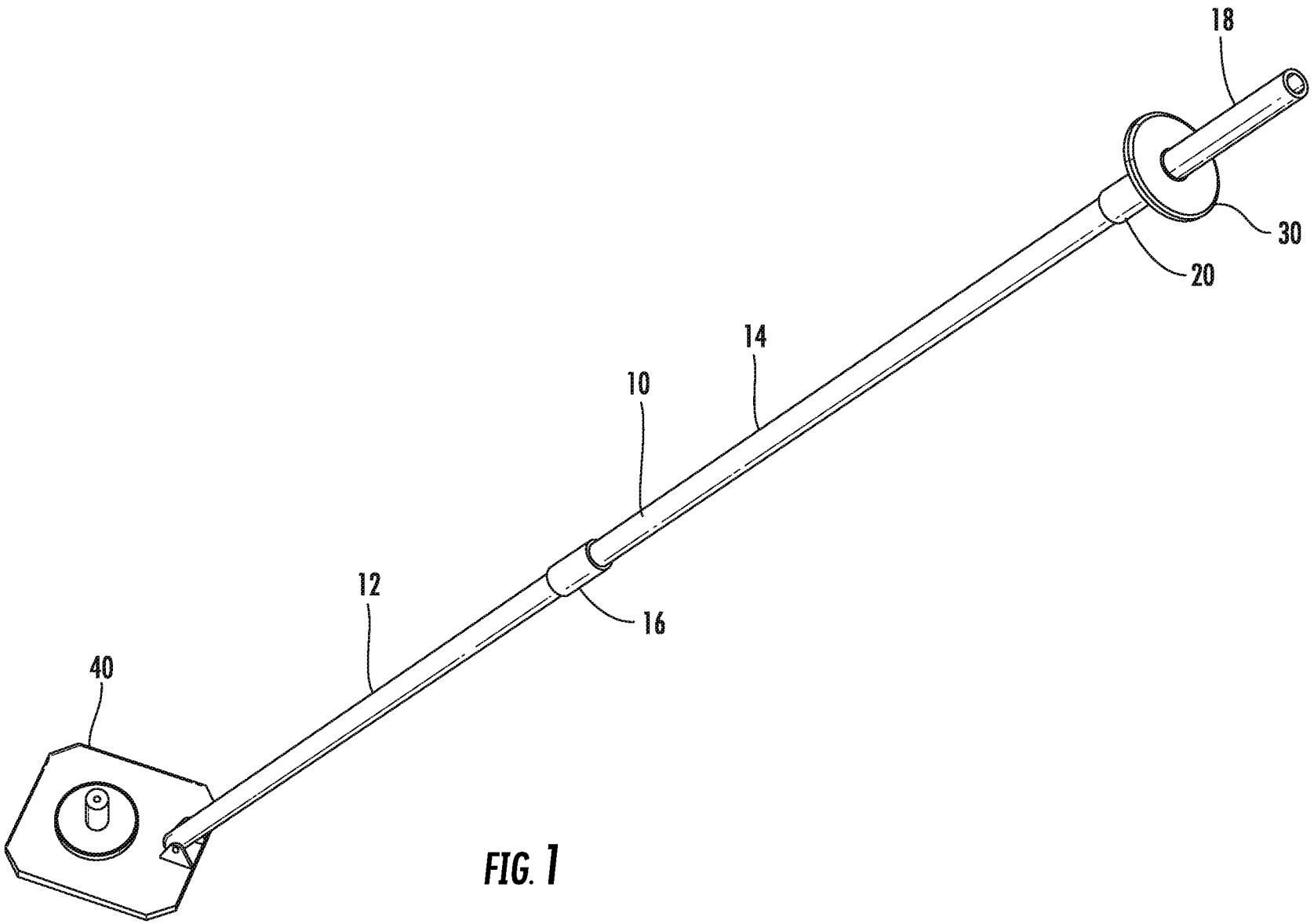
FIG. 1 is a perspective view of a fitness apparatus in the form of a walking stick attached on one end to a base.

As best seen in reference to FIG. 1, a fitness apparatus in the form of an exercise stick 10 is provided having a lower rod 12 attached at a lower terminus to a base 40 and secured to an upper rod portion 14 via a friction fit rod connector 16. An upper end of the rod defines a handle 18, handle 18 attached to an upper terminus of rod 14. The rod portions are adapted for securing a disk weight 30, such as a bar bell weight, which can be slipped over a terminus of handle 18 and engages a stop member 20. The components of the lower rod 12, upper rod 14, rod connector 16, handle 18, and stop member 20 can be formed from hollow tubing such as PVC pipe and various connectors for PVC pipe. Optionally, the handle portion could be provided by a telescopic member using a twist release/locking mechanism such as one employed on equipment tripods having telescopic legs.

Figure 2:
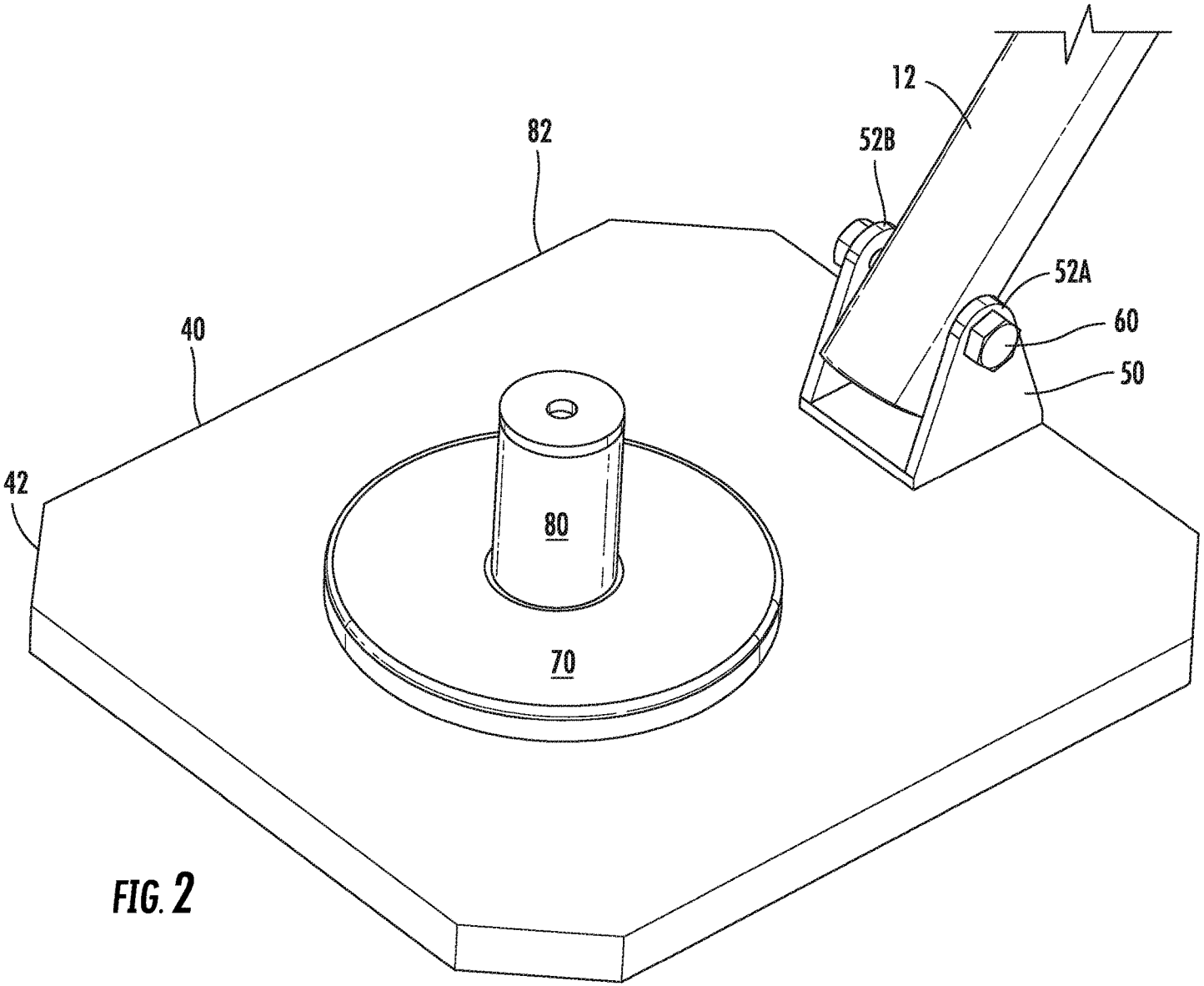
FIG. 2 is an enlarged view of the base of FIG. 1 showing the walking stick as secured to the base.

As been seen in reference to FIG. 2, the base 40 is a substantially flat substrate of a material such as ultra high molecular weight polyethylene. Other materials such as nylon, rigid plastics, wood or metal can be utilized. As seen in reference to FIG. 2, the corners 42 of the base 40 can be angled and the corners optionally rounded so as to provide for a base structure that does not have sharp 90 degree edges. The shape of the base 40 can also be varied from square, to rectangle, to circular, to oval shaped.

As further seen in reference to FIG. 2, a bracket 50 is supported on an upper surface of base 40, bracket 50 providing an opening between two raised shoulders 52A and 52B. Within the opening defined by shoulders 52A and 52B, a portion of rod 12 can be received within bracket 50 and secured within the bracket by a securing member 60 such as a pin, screw, or threaded bolt. As can be seen in reference to FIG. 2, a lower portion of the rod 12 can define a lateral bore extending through opposing side walls for receiving the securing member 60. The securement of the lower rod 12 within the bracket 50 allows for sufficient clearance at the terminal end of lower rod 12 such that the rod 12 can pivot freely in a back and forth motion within the cavity formed between shoulders 52A and 52B. This allows the lower rod 12 to pivot within bracket 50.

Preferably, bracket 50 is positioned on an edge of the upper surface of base 40 along a mid-line axis of base 40 such that when lower rod 12 is inserted, rod 12 is also positioned within the center mid line axis of base 40. Lower rod 12 is free to pivot substantially 180 degrees within bracket 50.

Figure 3:
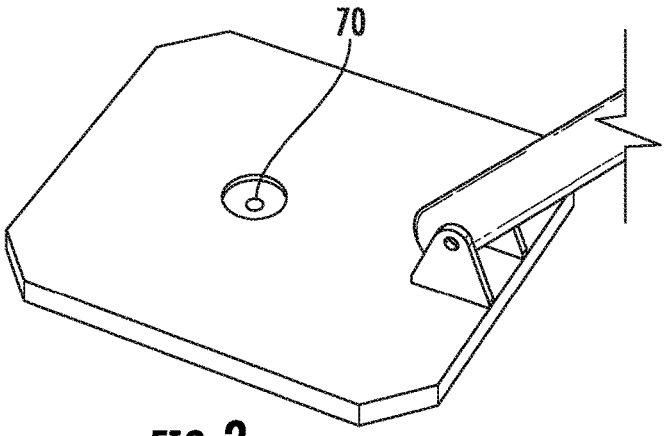
FIG. 3 is a perspective view showing details of the upper base surface.
Figure 4:
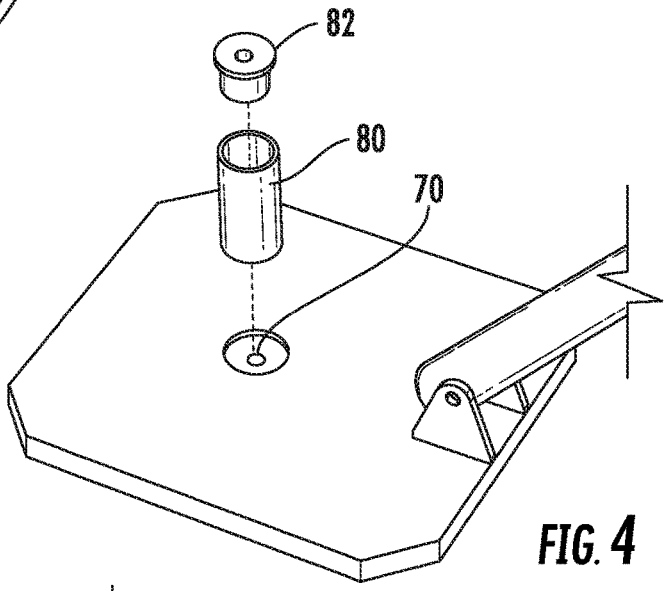
FIG. 4 is an exploded view similar to FIG. 3 showing an attachment feature for a weight added to the base.
Figure 5:
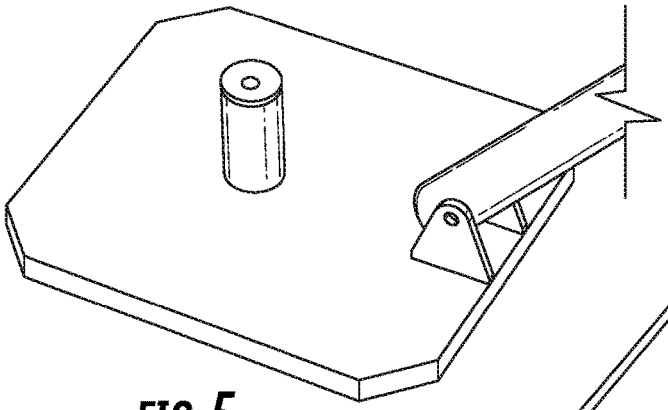
FIG. 5 shows further details of the attachment feature of FIG. 4.

As best seen in reference to FIGS. 3,4, and 5, an upper surface of base 40 defines a recessed region 70 which may be in the shape of a circle for receiving a complimentary shaped plug 80, plug 80 being additionally engaged on an upper terminus with an end cap 82. The plug 80 will provide a securing mechanism for a weight such as a flat disc weight similar to a bar bell (not illustrated). The additional weight allows a user of the fitness apparatus to increase the resistance of the fitness apparatus during use.

Figure 6:
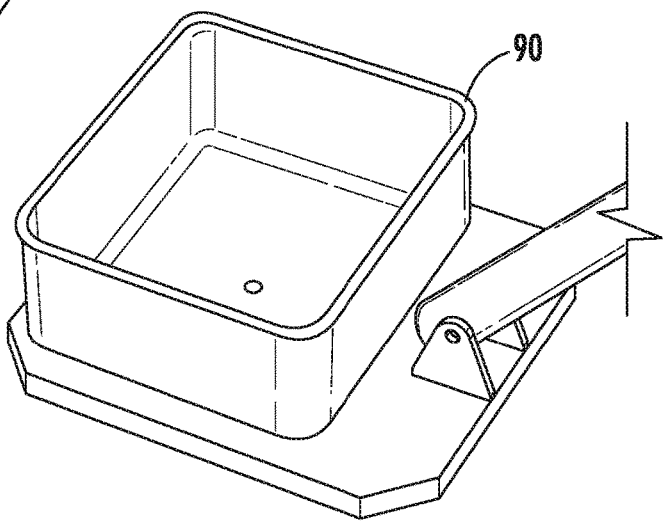
FIG. 6 is a perspective view of an alternative embodiment of the invention where the upper base supports a tray that may be used to hold weighted objects.

An optional feature, as seen in reference to FIG. 6, includes a container that can be secured to an upper surface of base 40 using a bottom projection, not shown, that is designed to engage recess 70. Container 90 can be used to support common household articles that can be used as weights such as a gallon jug of liquid, bottled water, bean bags, stones, bricks or other items that, when placed within the interior of container 90, will provide additional weight to the fitness apparatus.

Two fitness apparatuses 10 can be used as a pair of walking sticks, one fitness apparatus 10 for each user's hand. In a preferred embodiment of a process of using the fitness sticks, the user alternates moving their arms while holding handle 18 of the fitness sticks 10 while the base slides back and forth behind the person's body. In one preferred process, the person is stationary and is only moving the arms in a back and forth motion which moves the base 40 and any weights associated on base 40 in a sliding motion.

In one preferred embodiment, the base 40 is always maintained in a location behind the user with the user alternately extending the base behind the body and then pulling the base toward the user's body. The fitness apparatus lends itself to being used indoor on a carpeted surface where the bottom of the base can slide easily, through any smooth surface will suffice.

It is preferable that a bottom surface of the board 110 either define a low coefficient of friction material or have longitudinal rails or runners of a suitable material that facilitates use of the exercise apparatus 100 when used on hard surface flooring, carpeting, and a grassy outdoor area or walking track. If desired, rollers or wheels (not illustrated) could be placed on the bottom of the base 40.

The addition of a weight 30 to the handle 18 or 180 allows for an exercise stick that has therapeutic benefits for a user having limited mobility. An individual may remain seated in a chair and can pivot the stick handle back and forth without having to move the base 40. The weight 30 positioned on the top portion of handle 18 or 180 provides for a useful back and forth pivoting motion with the increased weight providing greater resistance that offers improved muscle tone and muscle development to the user.

As seen in reference to FIGS. 7-11, a second alternative embodiment of the invention is provided. As seen in reference to FIGS. 7-11 and in specific reference to FIG. 7, an embodiment of the exercise stick 110, base 140 has secured thereto a multi-walled receptacle 142. Receptacle 142 is formed by a front wall 150, a rear wall 152, and a pair of opposite side walls 154 and 156. Additionally, curved corner walls 158A-158D also are present and help define an internal volume of the receptacle 142.

Receptacle 142 additionally defines a floor 149 which may either be secured to a surface of base 30 or, alternatively, base 30 defines the floor structure 149.

Figure 7:
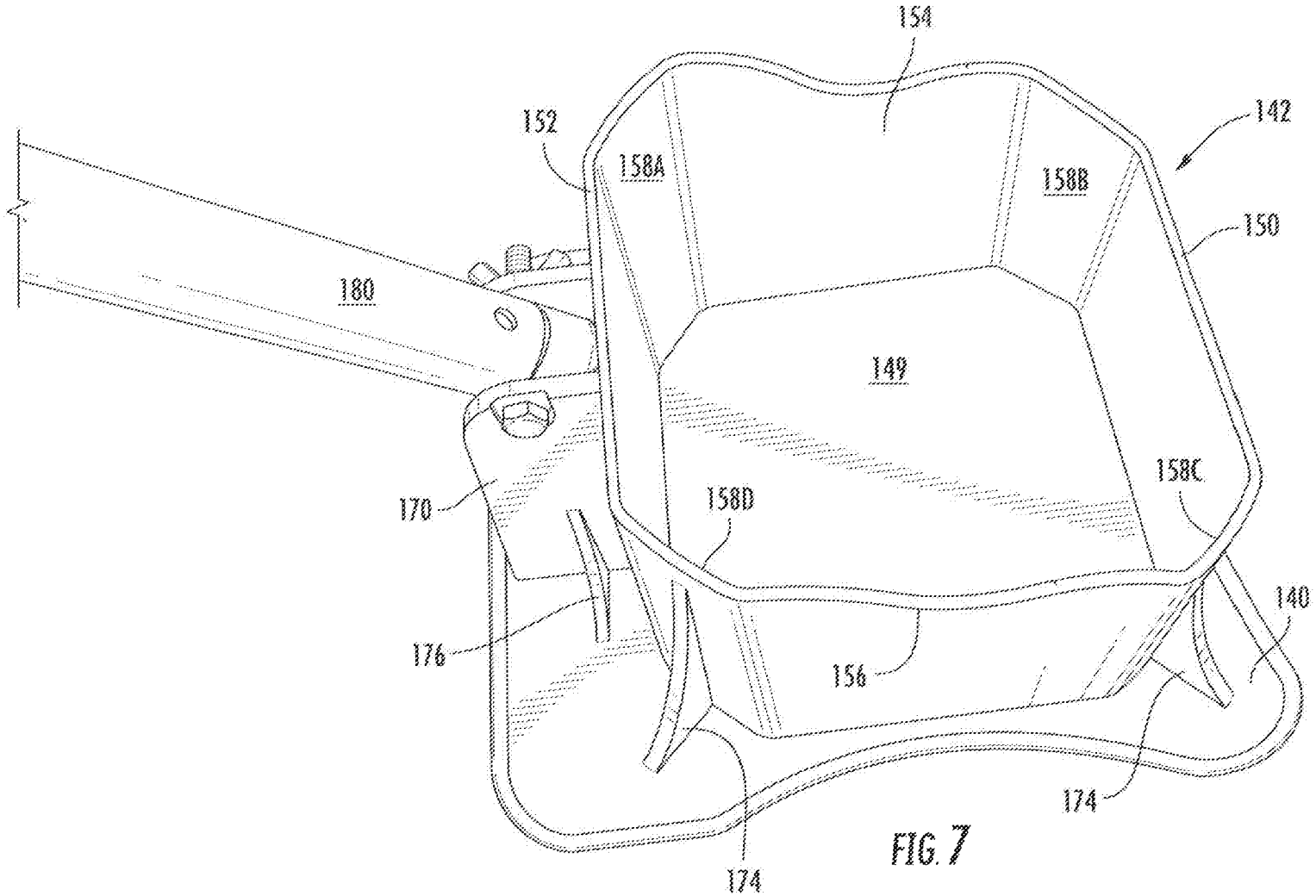
FIG. 7 is perspective view of a second alternative embodiment of the invention in which a platform supports an upper receptacle that is adapted for securing a standard gallon beverage container.
Figure 8:
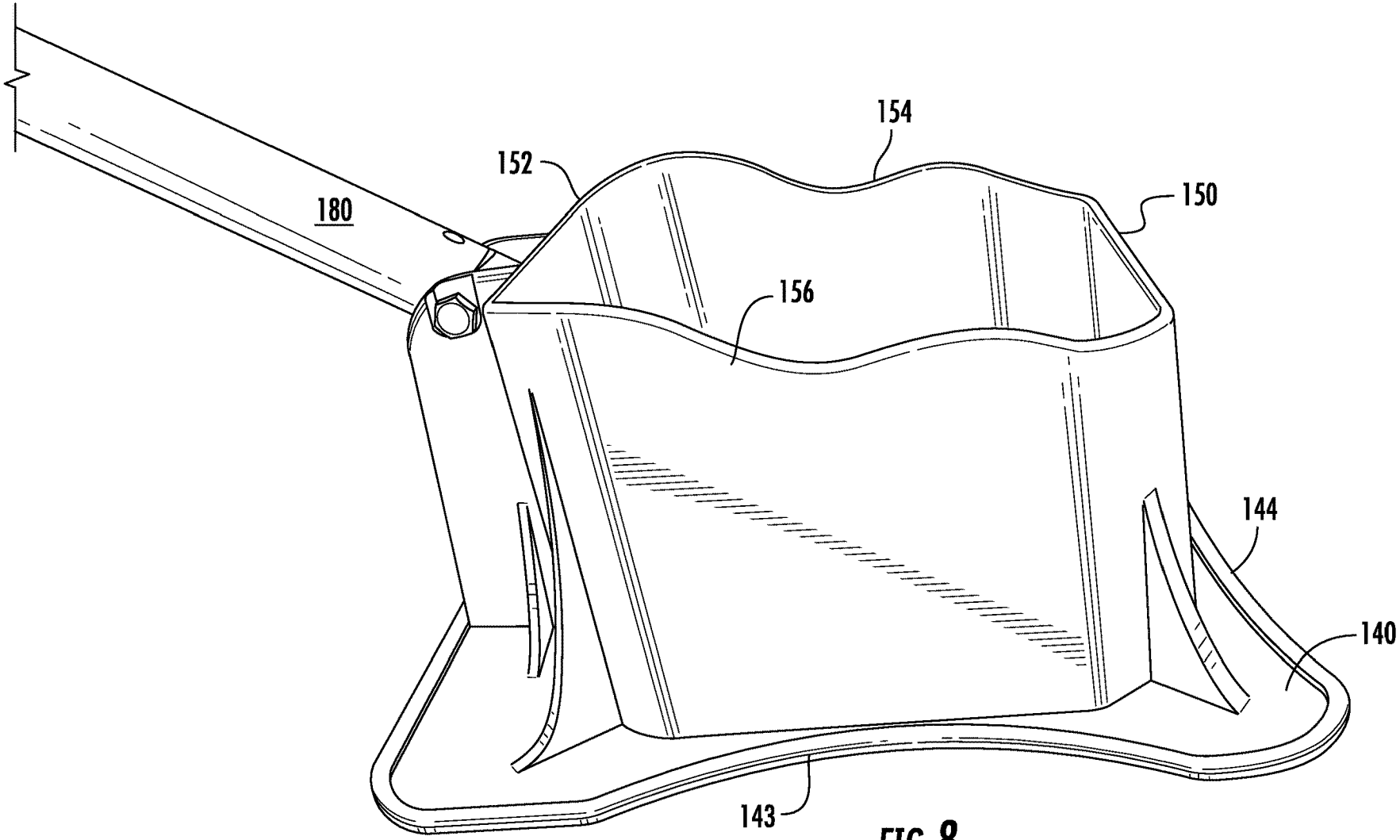
FIG. 8 is a side view of the fitness apparatus seen in FIG. 7.

As seen in reference to FIG. 8, the height of the rear wall 152 is greater than the height of the front wall 150. Accordingly, the corresponding side walls 154 and 156 slope generally downward from the rear wall to the front wall. As best seen in reference to FIGS. 7, 9 and 10, the side walls 156 and 154 further define a curve along a wall height near a mid-point of the respective side walls. The side wall curvature is such that a distance between the edge walls 154 and 156 along a mid-point of the respective side walls is less than a distance between respective portions of the edge walls more distal from the mid-point. Additionally, as best seen in reference to FIG. 9, the eight walls defining the sides of receptacle 142 flare outwardly from the floor 149 with respect to a central vertical axis defined by the receptacle 142.

Figure 11:
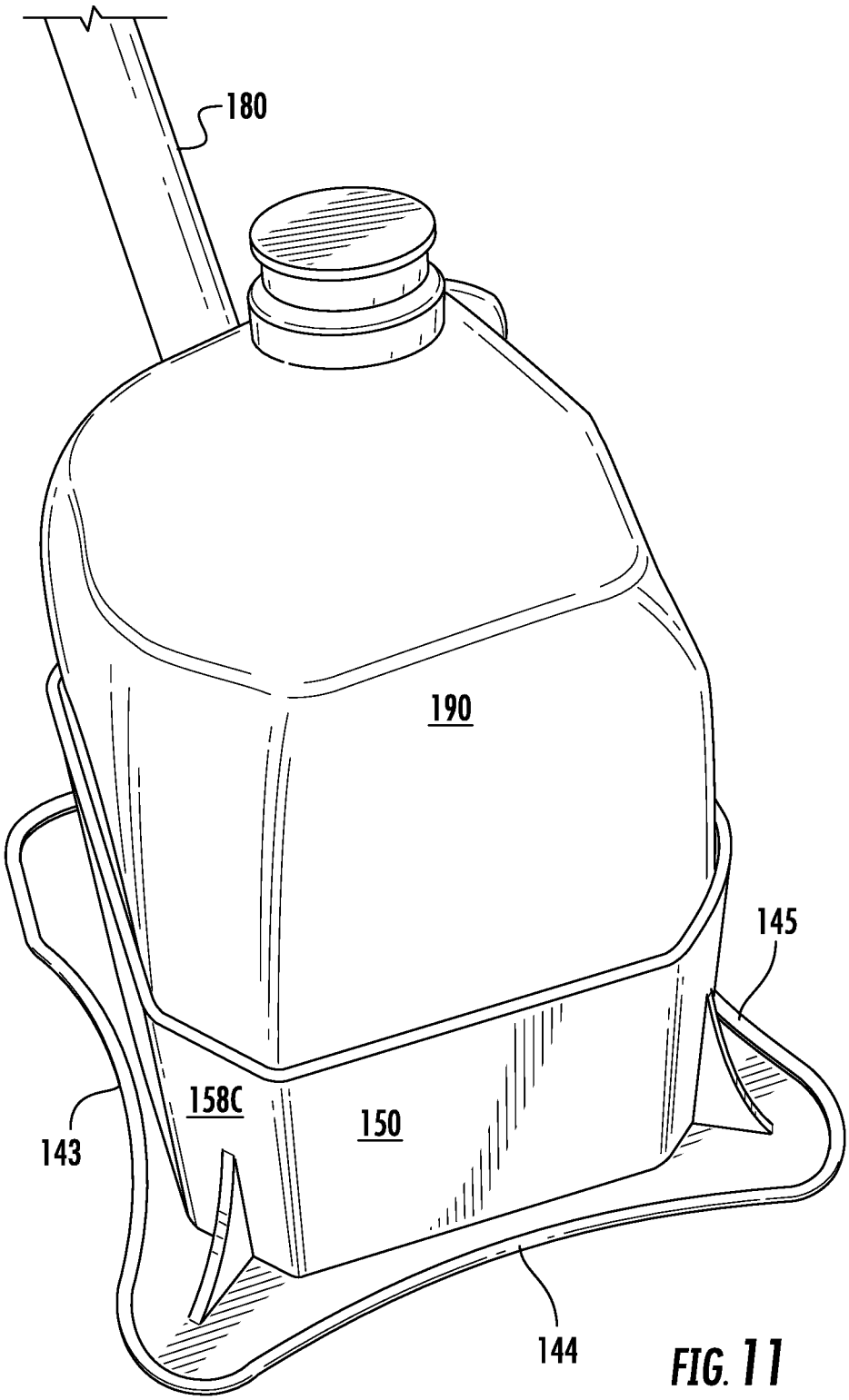
FIG. 11 is a front view of the fitness apparatus seen in FIG. 7 and additionally showing the fitness apparatus engaging a gallon sized container.

As best seen in reference to FIG. 11, the base front wall 144 and opposite base edge walls 143 and 145 define a curved margin such that a mid-point of respective edge walls 145 extend closer to the corresponding receptacle edge walls 154 and 156 than the more distal portions of the edge walls. The front base edge 144 is similarly asymmetrical with respect to the front wall 150.

Figure 9:
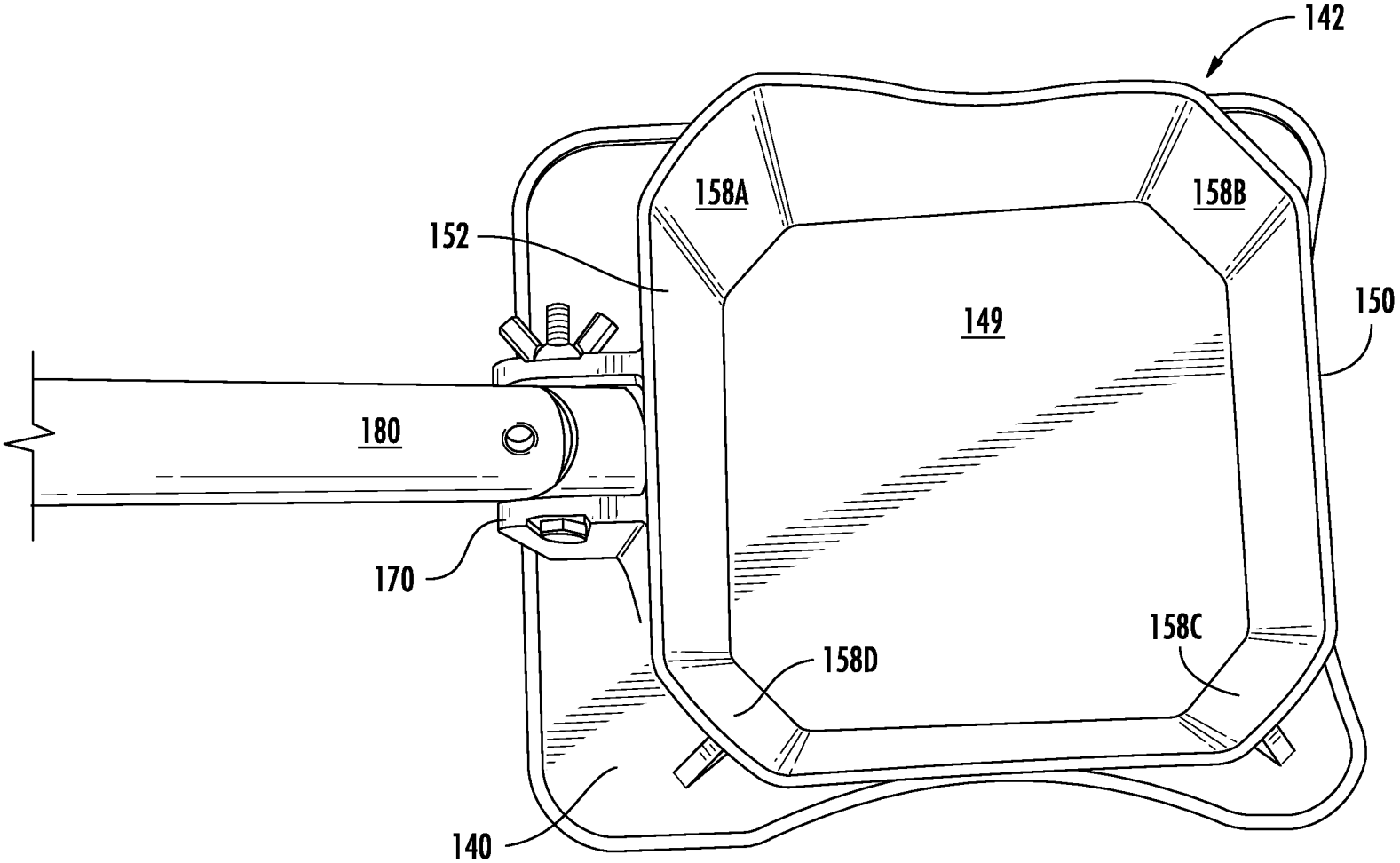
FIG. 9 is a top view of the fitness apparatus seen in FIG. 7.
Figure 10:
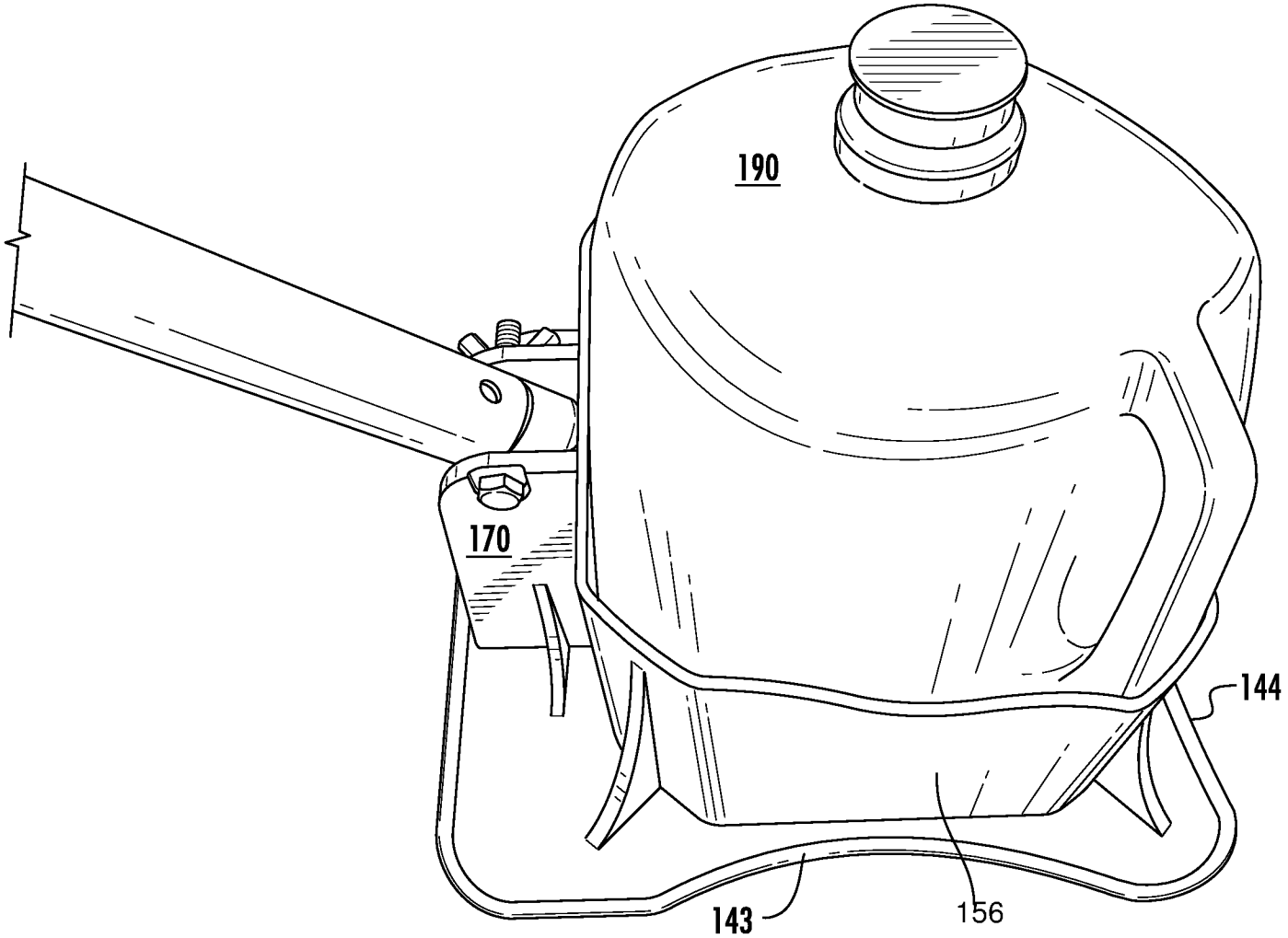
FIG. 10 is a side perspective view of the apparatus seen in FIG. 7 and further showing the apparatus engaging a standard gallon container.

Each portion of the corner walls 158A-158D is curved as seen in reference to FIGS. 7 and 9. An exterior of the rear wall 152 defines a bracket 170 (FIG. 7) which extends from the rear wall and runs substantially a height of the rear wall and is in further communication with a portion of the base 140. The bracket 170 is adapted for receiving a handle within a slot defined between the two edge bracket walls and secured by a fastening member similar to the arrangement seen and described in a reference to first embodiment of FIG. 2. Preferably, the handle 180 is secured along the pivot member near an upper edge of the bracket. It has been found that this facilitates better engagement and movement of the base 140, particularly when a weight bearing load is present within the defined receptacle 142. As seen in reference to FIG. 11, a conventional milk or water one gallon container 190, will nest within the volume of receptacle 142.

As further seen in reference to FIG. 7, buttruss-shaped supports 174 are positioned along the exterior of each wall 158A-158D. The support walls 174 provide a right angle support between the exterior portion of container walls 158A-158D and the upper surface of base 140. Similar shaped support walls 176 may be provided on one or more sides of the walls which define bracket 170.

The receptacle 142 is designed to provide a firm engagement with a conventional one gallon size container. The outward taper of the receptacle edge walls from the floor 149 to the upper edges of the respective receptacle walls helps receive and secure a one gallon container which may be partially or completely filled with liquid so as to provide additional weight for the exercise apparatus. Additionally, the curvature along the mid-point of the two side walls 154 and 156 provide an additional securing force to the milk/water container 190 as does the respective corner edge walls 158A-158D.

In accordance with this invention, it has been found that the base 140 and the receptacle 142 will securely retain a one gallon container 190 such that the container 190 is securely nested within the 8 walls which define the interior of the receptacle 142. As such, as the exercise apparatus is used in a back and forth motion, the container does not move relative to the interior walls of the receptacle 142. The amount of liquid placed in the container can be used to adjust the weight of the exercise stick 110.

The various embodiments of the walking sticks described herein can also be used for exercise as a person walks. The walking can be indoors, outdoors, and can also be used in conjunction with a treadmill. Additionally, the fitness apparatus can be moved and pivoted by a user sitting in a chair and can also be used for just a pivoting motion by keeping the base stationary while moving the rod handle back and forth along the pivot.

The exercise apparatus described herein can be used while walking and can also can be used for exercising in place by mimicking a walking or marching motion while moving the sticks in a back and forth motion. Similarly, the weighted handles can be pivoted or pushed and pulled while standing still with or without a twisting body motion to provide additional flexibility. For less ambulatory persons, the handles can be pivoted or pushed or pulled while sitting on the side of the bed, a chair, wheelchair or other non-standing position.

The various embodiments described herein lend themselves to use as an exercise tool that the number of conventional exercises. For instance, an individual doing abdominal crunches or sit-ups could have the fitness apparatus positioned behind the individual's head and with the respective handle ends on opposite sides of the persons head. As the individual goes through the sit-up motion, the exercise apparatus increases the resistance in both the sitting up motion as well in the reclining motion. When so used, the fitness apparatus provides increased resistance via the sliding motion of the apparatus on the floor as the individual raises his or her torso towards the Individual's knees and also provides a resistance force during the opposite motion as the individuals head and upper torso return to a horizontal position. Accordingly, the fitness apparatus can increase the intensity of crunches, sit-ups, and other exercises where the fitness apparatus is used during the performance of the exercise.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the claims as set forth herein. In addition, it should be understood that aspects of the various embodiments may be interchanged, both in whole, or in part. Therefore, the spirit and scope of the invention should not be limited to the description of the preferred versions contained therein.

That which is claimed:

1. A fitness apparatus comprising:

a base;

a multi-walled receptacle defining an interior space volume and secured to an upper surface of the base, the receptacle having a front wall, and rear wall, and a pair of opposing side walls, the receptacle further defining four corner walls, each corner wall defining a curved interior wall surface;

wherein, each opposing side wall defines an upper edge wherein a first height of the opposing side wall edge is greater along a portion closest to the rear wall than a second height of the opposing edge wall closer to the front wall; and wherein each of the opposing side walls defines a curvature along a wall height such that a curved portion of each side wall extends in the interior space defined by the receptacle.

2. The fitness apparatus according to claim 1 wherein a bracket is positioned along an upper exterior edge of the rear wall.

3. The fitness apparatus according to claim 1 wherein the base and the receptacle is made of ultra high molecular weight polyethylene.

4. The fitness apparatus according to claim 1 wherein the multi-walled receptacle is adapted for engaging an outer surface of a one gallon beverage container placed therein.

5. The fitness apparatus according to claim 1 wherein the base supporting the multi-wall receptacle defines a front edge and two opposite side edges that are curved inwardly along a mid-point of the respective front wall and side walls.

6. The fitness apparatus according to claim 2 wherein a handle is attached to the multi-walled receptacle via the bracket, the handle further defining a portion having a larger diameter stop member secured thereto, the larger diameter stop member adapted for supporting a weight placed over the handle.

7. A process of using a fitness apparatus comprising the steps of:

supplying a fitness apparatus comprising;

a base;

a multi-walled receptacle defining an interior space and secured to an upper surface of the base, the receptacle having a front wall, and rear wall, and a pair of opposing side walls, the receptacle further defining four corner walls, each corner wall defining a curved interior wall surface;

wherein, each opposing side wall defines an upper edge wherein a first height of the opposing side wall edge is greater along a portion closest to the rear wall than a second height of the opposing edge wall is relative to a portion of the edge wall closer to the front wall;

wherein each of the opposing side walls defines a curvature along a wall height such that a curved portion of each side wall extends in the interior space defined by the receptacle; and having user grip a respective handle attached to a respective multi-wall receptacle wherein the user extends the fitness apparatus behind the user's body and then slides the fitness apparatus towards the user's body.

8. The process according to claim 7 comprising the additional step of adding a weight to the receptacle.

9. The process according to claim 7 comprising the additional step of adding a weight to a portion of the handle.

10. The process according to claim 8 comprising the additional step of adding a weight to a portion of the handle.

11. A fitness apparatus comprising:

a base;

a multi-walled receptacle defining an interior space and secured to an upper surface of the base;

the base supporting the multi-walled receptacle defining a front edge and two opposite side edges that are curved inwardly along a mid-point of the respective front wall and side walls, the receptacle having a front wall, and rear wall, and a pair of opposing side walls, the receptacle further defining four corner walls, each corner wall defining a curved interior wall surface;

wherein, each opposing side wall defines an upper edge wherein a first height of the opposing side wall edge is greater along a portion closest to the rear wall than a second height of the opposing edge wall closer to the front wall; and wherein each of the opposing side walls defines a curvature along a wall height such that a curved portion of each side wall extends in the interior space defined by the receptacle.

12. The fitness apparatus according to claim 11 wherein the multi-walled receptacle is adapted for engaging an outer side of a one gallon beverage container placed therein.

* * * * *